US006431653B1

(12) United States Patent
Kleuters

(10) Patent No.: US 6,431,653 B1
(45) Date of Patent: Aug. 13, 2002

(54) TUNNEL-BORING MACHINE AND METHOD OF USING THE SAME

(75) Inventor: Nikolaus Kleuters, Geilenkirchen (DE)

(73) Assignee: Wirth Maschinen- und Bohrgeräte-Fabrik GmbH, Erkelenz (DE)

( * ) Notice: Subject to any disclaimer, the term of this patent is extended or adjusted under 35 U.S.C. 154(b) by 0 days.

(21) Appl. No.: 09/424,363

(22) PCT Filed: May 19, 1998

(86) PCT No.: PCT/DE98/01382

§ 371 (c)(1),
(2), (4) Date: Feb. 11, 2000

(87) PCT Pub. No.: WO98/54442

PCT Pub. Date: Dec. 3, 1998

(30) Foreign Application Priority Data

May 27, 1997 (DE) ..... 197 22 000

(51) Int. Cl.[7] ..... E21D 9/06
(52) U.S. Cl. ..... 299/31; 299/33; 405/141
(58) Field of Search ..... 299/31, 33; 405/138, 405/141

(56) References Cited

U.S. PATENT DOCUMENTS

| | | | | |
|---|---|---|---|---|
| 3,411,826 A | | 11/1968 | Wallers et al. | 299/31 |
| 3,870,368 A | * | 3/1975 | Winberg et al. | 299/31 |
| 4,953,914 A | * | 9/1990 | LeBegue | 299/33 X |
| 5,125,719 A | | 6/1992 | Snyder | 299/31 |
| 5,234,257 A | * | 8/1993 | Sugden et al. | 299/31 X |
| 5,765,925 A | * | 6/1998 | Kondo et al. | 299/31 |

FOREIGN PATENT DOCUMENTS

| | | |
|---|---|---|
| DE | 20 23 418 | 4/1971 |
| DE | 28 51 742 | 6/1980 |
| DE | 29 40 472 | 4/1981 |
| DE | 31 14 899 | 10/1982 |
| DE | 40 19 912 | 1/1992 |
| EP | 0 054 526 | 6/1982 |
| EP | 0 192 847 | 9/1986 |
| EP | 0 451 116 | 10/1991 |
| EP | 0 490 847 | 6/1992 |
| EP | 0 677 643 | 10/1995 |
| FR | 2 227 395 | 11/1974 |
| GB | 2065747 | * 7/1981 |

OTHER PUBLICATIONS

WIRTH; TB 539 MS; "Tunnel Boring Machine for Lesotho Project TB Ø5.39 m"; 4 sheets, undated.

Geratehersteller; "Probleme bie Maschinellen Tunnelvortrieben?"; TIEFBAU; Oct. 1993; pp. 770–773.

WIRTH; Kurzinfo; "Tunnel Boring Machine of Series TB 620/780"; 4 sheets, undated.

* cited by examiner

*Primary Examiner*—David Bagnell
*Assistant Examiner*—Sunil Singh
(74) *Attorney, Agent, or Firm*—Foley & Lardner

(57) ABSTRACT

The tunnel rock drill (100) for driving a tunnel bore optionally in open or shielded mode comprises a shield tail (33), which is connected to the drill head (10) and which covers optionally the bore wall over a defined length; a bracing device (20), which can be optionally fixed in the tunnel bore; at least one optionally activaatable advancement device (25), which, on the one hand, rests on the bracing device (20) and , on the other hand, acts on the drill head (10); and an optionally activatable force generator (35), which has a variable length and which, on the one hand, rests on a tubbing support (32) and, on the other hand, acts on the drill head (10). To introduce the advancement forces into the drill head in open mode, there is an inner kelly (16), which can be moved in the direction of boring in relation to the bracing device (20) and to which the advancement generator (25) is hinged and whose breast-sided end bears the drill head (10).

16 Claims, 3 Drawing Sheets

TUNNEL-BORING MACHINE AND METHOD OF USING THE SAME

BACKGROUND OF THE INVENTION

The invention relates to a tunnel rock drill of the type for driving a tunnel bore optionally in open or shielded mode, and also relates to a process for driving a tunnel bore, during which process the work varies from open to shielded mode, depending on the rock surrounding the tunnel bore.

When introducing tunnel bores, it is known to apply, for example, alternatingly the two following methods, depending on the nature of the soil.

a) In the so-called open mode there is free space behind the drill head. That is, the bore wall is not covered by any components of the apparatus, such as safety guards and the like. During the boring process support systems, such as steel rings, roof bolters and/or gunite linings, can be installed into this free space. In the region, in which the desired support systems are already installed, there is a bracing device, which can be braced, for example, radially, against the outer tunnel surface in order to divert the reaction forces, which are usually transferred by the drill head over a plurality of advancement cylinders, into the rock adjacent to the tunnel bore.

Since there are no burial structures or standing supports directly behind the drill head in open mode, this process is only appropriate for introducing tunnel bores in stable formations, where there is no risk that the unsupported section of the tunnel bore will collapse.

b) In the so-called shielded mode the drill head shield, which is usually provided behind the rotating part of the drill head, exhibits a so-called shield tail, whose outside diameter—depending on the rock's angle of convergence—is chosen somewhat smaller than the actual outside diameter of the drill head or also tapering conically toward the rear. The shield tail serves to brace the tunnel wall directly adjacent to the drill head room in order to prevent said wall from collapsing.

During the drilling process in the shielded mode a tubbing support is made inside the region covering the shield tail so as to leave space at the inside shell of the shield tail by assembling usually individual prefabricated concrete components with suitable aids into a tubular support that covers the entire tunnel wall. Since the shield tail and the tubbing support always overlap a certain amount over the longitudinal stretch of the tunnel bore, a collapsing of the tunnel wall is ruled out. Thus, the shielded method is suitable especially for introducing tunnel bores into soft rock or less stable formations.

In the shielded mode the tunnel work is done with so-called tubbing cylinders, which are provided between the (non-rotated) drill head shield and the front side of the tubbing support facing the longitudinal stretch of the bore. Hence reaction forces from tunneling and rotation pass into the tubbing support, or at the start of the shielded operation, i.e. when there is still no tubbing support, said forces pass into a steel ring, which is braced radially against the rock.

Especially in the case of longer tunnel bores these holes often extend through different rock formations, with the result that both methods have to be applied alternatingly. In this case it is well-known, as a function of the respective rock formations, to transport to the breast and to set up there different devices that are appropriate for the application of the respective method. This procedure is disadvantageous since the mandatory assembly and disassembly of both devices are time-consuming and thus the production costs of boring are significantly increased.

There exists a tunnel rock drill of this class that is made by the Wirth company in Erkelenz. It is suitable not only for use in hard rock but also in soft rock formations. That is, it works, as desired, according to the open method or according to the shielded method. This device comprises a shield tail, which always covers the tunnel space directly behind the drill head shield and which comprises two shield tail segments that mate telescopically. The telescopic overlapping of the shield tail segments takes place over a length that is greater than the maximum stroke of a plurality of advancement cylinders, provided inside the shield tail so that, irrespective of the operating state, the bore wall is completely covered by the shield tail in this region.

The advancement cylinders extend between the rear wall of the drill head shield and a bracing device, which can be braced—as stated above—radially against the bore wall in order to absorb the drill reaction forces, to the extent that the properties of the rock formation allow this.

In order to apply the device in the shielded mode, the bracing device has tubbing cylinders that are distributed over the circumference of the bore and that face the rear with respect to the direction of boring. Said tubbing cylinders are appropriate for bracing in the aforementioned manner against an already completed tubbing support or an installed steel ring and thus to transfer the boring reaction forces into the tubbing support when the bracing device is released.

If this tunnel rock drill is used in hard rock, the tubbing cylinders are inactive, while the bracing device is braced against the tunnel wall in order to absorb the reaction forces. The drill head advances by extending the advancement cylinders; during this advancing procedure the telescopic shield tail is simultaneously advanced. If the tunnel bore, which is advanced in this manner and by appropriately installing the bracing device afterwards, comes upon soft rock formations, the bracing device is deactivated, and the drill reaction forces are diverted in the manner already described over the tubbing cylinders into the tubbing support.

Of course, this device can also be used to drive the tunnel bore in alternating rock formations without the need of the time-consuming, complete retrofitting of the tunnel rock drill. However, the drawback is that, since the telescopic shield tail is always extended during the boring operation, significant lengths of the tunnel bore area adjacent to the drill head room are covered by the shield tail. Thus, on the one hand, it is not possible to install the desired support systems in the tunnel wall directly next to the drill head room in the case of hard rock; on the other hand, the length of the shield tail prevents any changes in direction. Furthermore, owing to its telescopic design the shield tail exhibits a recess, into which material, collapsing from the tunnel mantle, can penetrate and prevent the shield from being extended and thus prevent or even block the advancement. This is especially problematic when rock formations, which have a tendency to converge, necessitate the use of a shield tail that converges conically toward the rear.

SUMMARY OF THE INVENTION

The invention is based on the problem of improving to such an extent a tunnel rock drill of this class that is appropriate for both the open and the shielded mode and thus for driving the tunnel bore in both hard rock and soft rock formations that these drawbacks are remedied.

The problem is solved by a tunnel rock drill comprising a drill head; a shield tail, which is connected to the drill head and which covers optionally at least in part the bore wall over a defined length; a bracing device, which can be optionally fixed in the tunnel bore and which serves to divert the reaction forces generated by the boring process; at least one optionally activatable advancement device, which, on the one hand, rests on the bracing device, and, on the other hand, acts on the drill head in order to drive the drill head with advancing forces in the open mode; at least one optionally activatable force generator, which has a variable length and which, on the one hand, rests on the tubbing support or an abutment for the tubbing support and, on the other hand, acts on the drill head in order to drive the drill head with advancement forces in shielded mode; and an inner kelly, which can be moved in the direction of boring in relation to the bracing device and whose breast-sided end bears the drill head, and by hinging the at least one advancement device to the inner kelly.

Since the tunnel rock drill comprises an inner kelly, which can be moved with respect to the bracing device and whose breast-sided end bears the drill head and the advancement devices are hinged to the inner kelly, the bore area directly adjacent to the drill head room is no longer covered by the advancement devices so that this design alone results in better access to the bore wall. Furthermore, this design makes it possible to arrange the permanent parts of the advancement device that rest on the bracing device in such a manner that only the moveable components of the advancement devices project in principle beyond the breast. Thus, this design eliminates the need for a telescopic design of the shield tail, as compared to the device of this class, and its length can be reduced. Hence it is much easier to change directions during the tunnel boring operation.

A design in which the shield tail is designed in such a manner that the bore wall area covered by the same can be exposed as desired is especially advantageous. This measures allows the length of the constantly covered bore area to be decreased even more, with the result that, on the one hand, the support systems to be installed in the hard rock can be placed even closer behind the breast and, on the other hand, an even tighter change in direction can be attained. The design, according to claim 2, can be made, for example, in that the shield tail comprises several pipe segments, which are divided in the longitudinal direction and can be either removed from the drill head shield or attached so as to fold over in the direction of the bore center.

The inner kelly is also preferably in the bracing device itself, and in particular can be slid longitudinally, but is rotationally rigid. Owing to these measures the inner kelly is always in essence in the bore center so that there always remains maximum space to install the support systems at the bore wall. On the other hand, instantaneous reaction forces can also be transferred over the inner kelly and the bracing device into the rock formation, forming the bore wall.

Preferably there is then a drive block, with which the drill head can be set into rotation, between the drill head and the inner kelly. In so doing, the drive block is designed in such a manner that the drive reaction moments are introduced directly into the inner kelly.

In an especially preferred embodiment of the tunnel rock drill of the invention, the drill head is hinged to the inner kelly, and in particular in such a manner that in operation the drill head's axis of rotation can be swivelled relative to the inner kelly's longitudinal axis. Owing to this measure, and especially in combination with a design where the inner kelly is positioned in the bracing device so as to be swivelled around an arbitrary axis perpendicular to its longitudinal axis, and owing to the possibility of minimizing the longitudinal stretch of the drill head due to the removed shield tail, an especially tight change in direction in the tunnel bore can be attained.

The drill head's change in direction, i.e. the swivelling of its axis of rotation with respect to the bore longitudinal axis, takes place preferably with the aid of a controller, whose length can be varied and which is connected, on the one hand, to a part of the drill head or the drive block that is rotationally rigid and, on the other hand, to the inner kelly.

The drill head's mounting on the inner kelly can be relieved, if the controller is designed in such a manner that it can serve to both transfer the advancement reaction forces from the drill head to the inner kelly and vice versa.

In a preferred design of the tunnel rock drill of the invention, the controller, the advancement devices and/or the force generators are formed by hydraulicly operated piston-cylinder units.

The articulated connections between the drill head and inner kelly and/or between inner kelly and bracing device are formed by ball joints.

The drill head is driven preferably electrically and/or hydraulicly.

A preferred embodiment of the tunnel rock drill comprises integrated means for simultaneous installation of bore supports and/or boardings during the boring operation, which are designed so as to be permanent with respect to the bore wall. With these measures the time that is required to advance a bore stroke is used to install the support systems.

The means for installing the bore supports and/or boardings are preferably arranged between the drill head and the bracing device so that the support systems can be installed directly adjacent to the drill head room.

The drill cuttings, detached from the breast, are carried away during the boring operation preferably with the aid of a drill cuttings conveyor, which runs through the inner kelly. This measure does not restrict the free space required behind the drill head for the tunnel support.

The process of the invention, during which process the work varies from open to shielded mode, depending on the nature of the rock surrounding the tunnel bore, comprises, during open mode, transferring advancement forces from a bracing device over an inner kelly, which bears the drill head on its breast-side end; and, during shielded mode, introducing the advancement forces in the drill head over at least one force generator, acting between a tubbing support or an abutment for the tubbing support and the drill head.

The drawings depict one embodiment of the invention.

DETAILED DESCRIPTION

Figure 1:
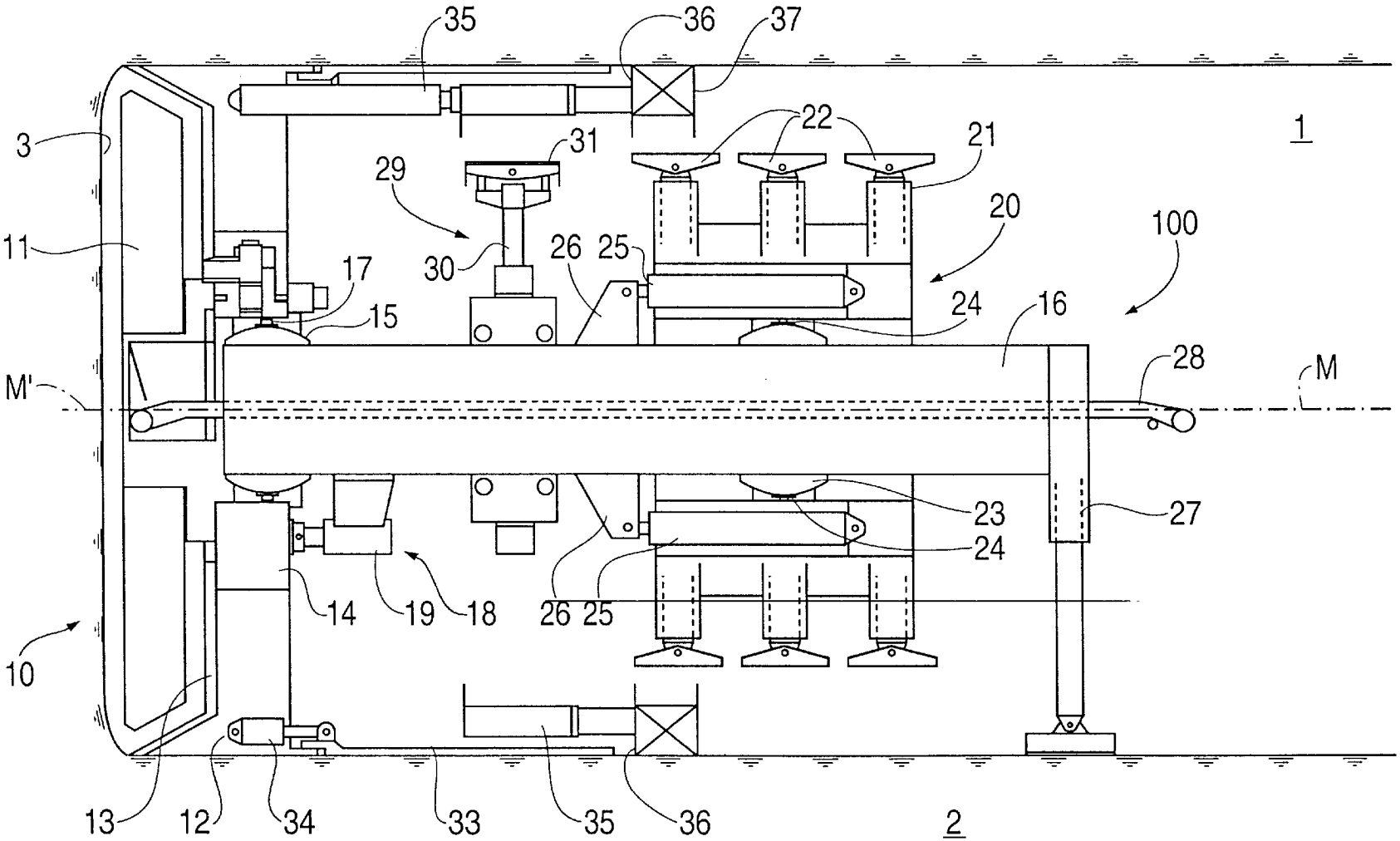
FIG. 1 is a longitudinal view along the tunnel axis through the front part of a tunnel rock drill, working according to the shielded method, followed by the bracing device.

The tunnel rock drill, all of which is labeled 100, serves to open a tunnel 1 in the ground 2. The drawing shows only those components that are important for the invention.

When the concept "front" is used in the following, it refers to that part of the tunnel rock drill 100 that is facing the breast 3 on the left side of the drawing. Hence the concept "rear" refers to that side of the tunnel rock drill 100 that faces away from the breast 3 on the right side of the drawing.

The front part of the tunnel rock drill 100 adjacent to the breast 3 exhibits a central axis M, which largely agrees with the central axis of the tunnel 1, where the latter does not have to be straight but rather can be arched. Similarly the inner kelly can be moved in relation to the tunnel axis.

The tunnel rock drill 100 comprises a drill head, all of which is labeled 10. It comprises largely a rotating drill tool holder 11, which serves to mine the rock at the breast; a rigid drill head shield 12, which attaches itself to the rock in the rear and which separates the actual drill head room 13 from the already opened tunnel; and a drive block 14, which is usually electrically or hydraulicly driven and sets the drill tool holder 11 into rotation. The components forming the drill head 10 and the drive head constitute the usual components of the prior art so that there is no need here to go into the details.

The drill head 10 and the drive block 14 are mounted by means of a bearing 15 on an inner kelly 16, which extends to the rear. The bearing 15 is designed in such a manner that the drill head 10 and the drive block 14 can be swivelled in such a manner that the central axis of the drill head M is tipped at a fixed angle in relation to the central axis M during the boring operation. This design enables the direction of the tunnel bore to be changed. Moreover, the bearing 15 comprises instantaneous transfer elements 17 so that the reactions moments generated by the drive of the drill tool holder 11 are passed through the bearing 15 into the inner kelly 16.

The transfer of the advancement forces and the swivelling of the drill head 10 is provided by a controller 18, which interacts, on the one hand, with the inner kelly 16 and, on the other hand, with the drill head shield 12 or a rotationally rigid part of the drive block 14. In the embodiment of the tunnel rock drill of the invention shown in FIG. 1, the controller 18 is formed by a piston-cylinder unit 19. Of course, it is also possible to use other or additional force generators, which have variable length and are distributed over the circumference of the inner kelly 16, than the controller.

The inner kelly 16 extends to the rear up to and through a bracing device 20, which comprises a plurality of piston-cylinder units 21, whose radially outer ends are equipped with bracing claws 22. Since in FIG. 1 the operating state of the tunnel rock drill 100 of the invention depicts the subsequent placement of the bracing device, the piston-cylinder units 21 are in the retracted state so that the bracing claws 22 do not rest against the tunnel wall, but rather the device rests on the rear brace 27.

A bearing 23 serves to position the inner kelly 16 in the bracing device 20. Said bearing is designed in such a manner that the inner kelly can be swivelled in relation to the bracing device 20 and moved in the longitudinal direction, but cannot be rotated, whereby the latter property is accomplished in turn by the instantaneous transfer elements 24, provided in the bearing 23.

In the embodiment shown in the drawing the bracing device 20 houses two advancement devices 25, which are designed as piston-cylinder units. They are braced, on the one hand, at the bracing device 20 and, on the other hand, over radial continuations 26 at the inner kelly 16 so that the forces exerted by the advancement devices 25 can be introduced over the inner kelly 16 and the controller 18 into the drill head 10.

At the rear end the inner kelly 16 has an extendable support device 27, which is shown in its extended position, where it rests against the bore wall or the inside wall of a bore support, during the post-positioning operation shown in FIG. 1. With the aid of the bracing device 27, which can also be designed as a parallelogram, i.e. can be moved in the conventional manner at right angles to the tunnel axis, the inner kelly 16 can be held in the tunnel center, when the bracing device 20 is not activated.

In the embodiment of the tunnel rock drill 100 depicted in the drawing, the inner kelly exhibits a square cross section, i.e. it is designed as a type of box profile, A drill cuttings conveyor 28 of the known type, which serves to carry away the drill rock cut free from the breast 3, extends through the interior of the inner kelly.

Between the drill head 10 and the bracing device 20 is so-called erector 29, which can be moved in the direction of the center axis M. Said erector comprises an extendable central member 30 and a holder 31, attached to the end of the central member 30. Said holder serves to move the finished components—for example made of concrete—to build the tubbing support 32, which is shown as a schematic drawing in FIG. 2.

Figure 2:
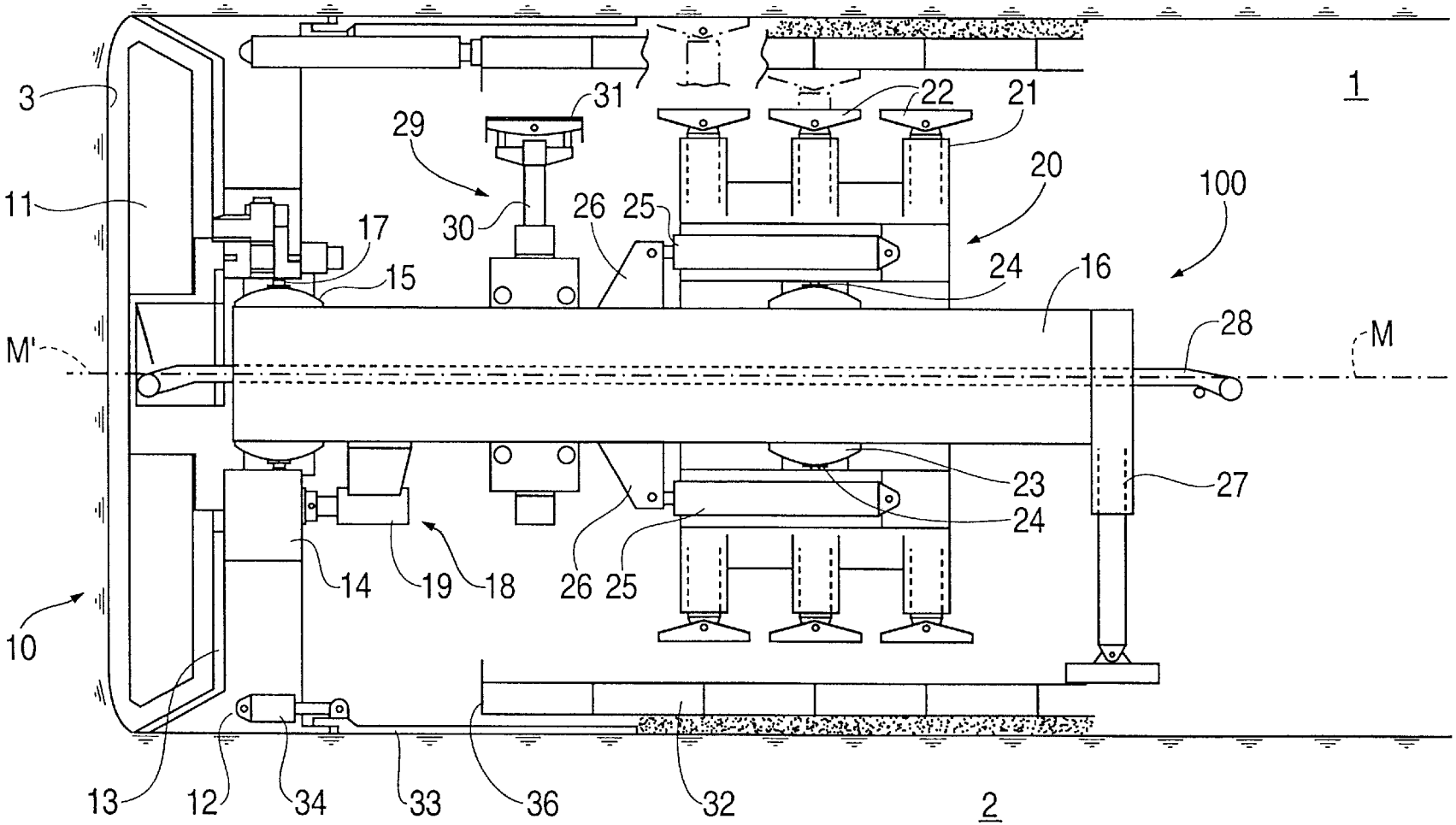
FIG. 2 is an equivalent view of the same tunnel rock drill as it is advancing the tunnel bore in a soft rock formation

Attached to the rear of the drill head shield 12 is a shield tail 33, which covers a fixed area of the bore inner wall and which braces the wall of a tunnel bore, which has advanced in a soft rock formation but has not been secured yet with a tubbing support 32, against collapsing. The shield tail 33 is connected to the drill head shield 12 by means of a series of piston-cylinder units 34, which are distributed over the circumference and of which only one is illustrated in FIGS. 1 and 2. With the aid of the piston-cylinder units 34 the shield tail 33 can be moved slightly in relation to the drill head shield 12, as it becomes necessary when the drill head 10 is to be swivelled in relation to the axis M in order to change the direction of the tunnel bore.

In the shielded mode shown in FIG. 1, the bracing device 20 is, as stated above, inactive. Both the advancement of the drill head 10 and the absorption of the drive reaction moments are provided by a plurality of force generators 35, whose length can be varied and which are distributed over the circumference of the tunnel bore. FIGS. 1 and 2 depicts only one complete force generator as an example. The force generators 35, whose length can be varied and which are designed preferably as piston-cylinder units and can be removed optionally, extend between the drill head shield 12 and face wall 36, which faces the breast 3 and is present in the bore. At the start of the shielded mode said front wall is formed, as illustrated in FIG. 1, but a steel ring 37, which is braced against the bore wall; as the tubbing support operation advances, said front wall is formed, as shown in FIG. 2, by the front side of the tubbing support itself.

In the following the different operating modes that are possible with the tunnel rock drill of the invention shall be explained:

a) FIG. 1 shows the tunnel rock drill in the shielded mode in a soft rock formation with the bracing device being placed subsequently in position. The rear section of the inner kelly 16 and the inactivated bracing device 20 rest on the support device 27. Since there is no tubbing support yet, the steel ring 37, which is forced against the bore wall and against which the drill head 10 is braced over the length-variable force generators 35, serves to absorb the advancement and instantaneous reaction forces during the subsequent boring operation, during which the bracing device 30 is in its activated operating state, as shown by the dashed line in FIG. 1, whereas the bracing device 27, which is also shown with a dashed line, is deactivated. The drill head is advanced by extending the force generators 35. The existing shield tail 33 prevents the bore wall from collapsing in the area behind the actual drill head room 13.

b) FIG. 2 also shows the tunnel rock drill 100 in the shielded mode during the boring process, and in particular as the boring process continues to advance in the soft rock, so that a tubbing support 32 already supports the bore wall. The bracing device 20 was activated prior to the start of the boring process in that by extending the piston-cylinder unit 21 the bracing claws 22 were moved out of the position, shown by the dashed line in FIG. 2, and into the extended position in which they rest against the tubbing support 32 of the tunnel bore. In contrast the bracing device 27 is retracted from the operating position, which is shown with a dashed line, so that the inner kelly 16 can be moved only in the direction of the tunnel bore in relation to the bracing device 20. To absorb the advancement and instantaneous reaction forces, the force generators 35 are now braced against the front side 36 of the tubbing support.

Figure 3:
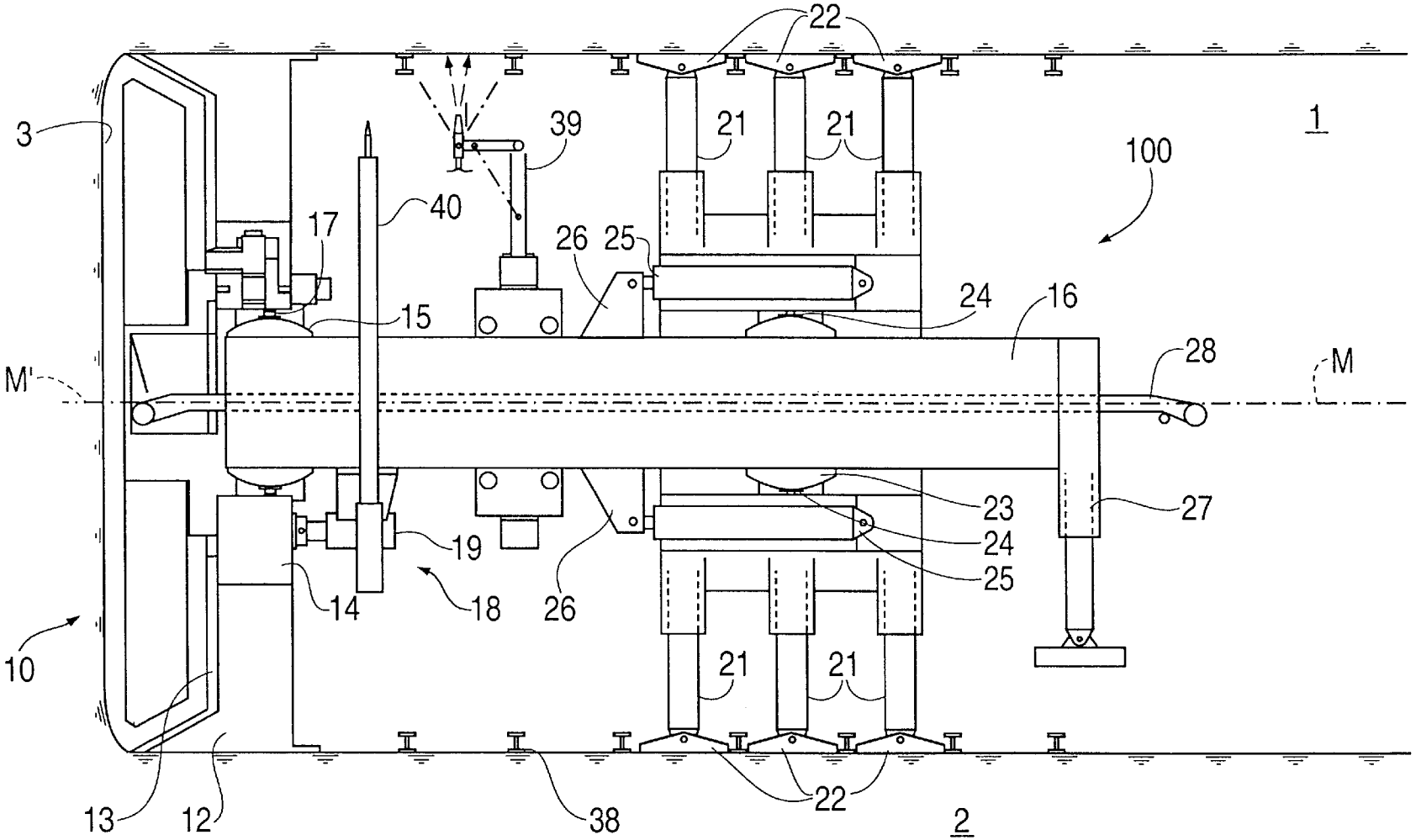
FIG. 3 depicts the same tunnel rock drill working according to the open method.

As especially evident from the bottom portion of FIG. 2, the tubbing support takes place inside the area covered by the shield tail 33 so that a collapsing of the rock material at the bore wall can be reliably prevent.

c) FIG. 3 shows at this point the operating mode of the tunnel rock drill 100. As immediately evident, there is no tubbing support here. Only steel supports 38 are provided to secure the bore wall. The advancement and instantaneous reaction forces are absorbed by the activated bracing device, whose bracing claw 22 is now forced against the bore wall using the piston-cylinder unit 21. The advancement is done exclusively by the advancement devices 25 so that the force generators 35 can be removed for the sake of better access to the bore wall adjacent to the drill head shield 12. Since no shield tail 33 is required to brace the bore wall, it being removed or even just hinged, the bore wall area adjacent to the drill head shield 12 is immediately accessible for installing support systems.

FIG. 3 depicts a concrete gun 39 and a roof bolter 40 as an example.

In summary with the tunnel rock drill 100 one can readily alternate between the shielded and the open mode. One needs only to activate or deactivate the bracing device 20 and to remove or install the force generators 35 and the shield tail 33.

What is claimed is:

1. Tunnel rock drill for driving a tunnel bore optionally in open or shielded mode, comprising:

a drill head, a shield tail which is connected to the drill head and covers a part of the bore wall over a defined length in the shielded mode and which does not cover the part of the bore wall in the open mode, a bracing device which can be optionally fixed in the tunnel bore and which serves to divert the reaction forces generated by the tunnel bore during boring, at least one optionally activatable advancement device which, on the one hand, rests on the bracing device and, on the other hand, acts on the drill head in order to drive the drill head with advancing forces in the open mode, at least one optionally activatable force generator which has a variable length and which, on the one hand, rests on a tubbing support or an abutment for the tubbing support and, on the other hand, acts on the drill head in order to drive the drill head with advancement forces in the shielded mode, and an inner kelly whose breast-sided end bears the drill head and which can be moved in the direction of boring in relation to the bracing device by hinging the at least one advancement device to the inner kelly.

2. Tunnel rock drill, as claimed in claim 1, wherein the inner kelly is mounted in the bracing device so as to slide longitudinally, but is rotationally rigid, and that the drill head is rotationally hinged on the inner kelly.

3. Tunnel rock drill, as claimed in claim 2, further comprising a drive block, with which the drill head can be set into rotation, between the drill head and the inner kelly which is designed in such a manner that the drive reaction moments can be introduced into the inner kelly.

4. Tunnel rock drill, as claimed in claim 1, wherein the drill head is hinged to the inner kelly in such a manner that in operation the drill head's axis of rotation can be swivelled in relation to the longitudinal axis of the inner kelly.

5. Tunnel rock drill, as claimed in claim 4, further comprising at least one controller which has a variable length and which is connected, on the one hand, to a part of the drill head or to a rotationally rigid part of a drive block and is connected, on the other hand, to the inner kelly.

6. Tunnel rock drill, as claimed in claim 5, wherein at least one of the controller, the advancement device and the force generator are formed by hydraulicly operated piston-cylinder units.

7. Tunnel rock drill, as claimed in claim 1, wherein the drill head is driven electrically.

8. Tunnel rock drill, as claimed in claim 1, further comprising means for simultaneous installation of at least one of bore supports and boardings during the boring operation.

9. Tunnel rock drill, as claimed in claim 8, wherein the means are arranged between the drill head and the bracing device.

10. Tunnel rock drill, as claimed in claim 1, wherein the drill cuttings, detached from the breast, are carried away by means of a drill cuttings conveyor, which runs through the inner kelly.

11. Tunnel rock drill, as claimed in claim 1, the drill head is driven hydraulicly.

12. Tunnel rock drill for driving a tunnel bore optionally in open or shielded mode, comprising:

a drill head, a shield tail which is connected to the drill head and covers a part the bore wall over a defined length in the shielded mode and which does not cover the part of the bore wall in the open mode, a bracing device which can be optionally fixed in the tunnel bore and which serves to divert the reaction forces generated by the tunnel bore during boring, at least one optionally activatable advancement device, which, on the one hand, rests on the bracing device and, on the other hand, acts on the drill head in order to drive the drill head with advancing forces in the open mode, at least one optionally activatable force generator which has a variable length and which, on the one hand, rests on a tubbing support or an abutment for the tubbing support and, on the other hand, acts on the drill head in order to drive the drill head with advancement forces in the shielded mode, and an inner kelly whose breast-sided end bears the drill head and which can be moved in the direction of boring in relation to the bracing device by hinging the at least one advancement device to the inner kelly, wherein the drill is hinged to the inner kelly in such a manner that in operation the drill head's axis of rotation can be swivelled in relation to the longitudinal axis of the inner kelly, and wherein the inner kelly is mounted in the bracing device so as to be swivellable around an arbitrary axis, perpendicular to its longitudinal axis.

13. Tunnel rock drill for driving a tunnel bore optionally in open or shielded mode, comprising:

a drill head, a shield tail which is connected to the drill head and covers a part the bore wall over a defined length in the shielded mode and which does not cover the part of the bore wall in the open mode, a bracing device which can be optionally fixed in the tunnel bore and which serves to divert the reaction forces generated by the tunnel bore during boring, at least one optionally activatable advancement device which, on the one hand, rests on the bracing device and, on the other hand, acts on the drill head in order to drive the drill head with advancing forces in the open mode, at least one optionally activatable force generator which has a variable length and which, on one hand, rests on a tubbing support or an abutment for the tubbing support and, on the one hand, acts on the drill head in order to drive the drill head with advancement forces in the shielded mode, an inner kelly whose breast-sided end bears the drill head and which can be moved in the direction of boring in relation to the bracing device by hinging the at least one advancement device to the inner kelly, and at least one controller which has a variable length and which is connected, on the one hand, to a part of the drill head or to a rotationally rigid part of a drive block and is connected, on the other hand, to the inner kelly, wherein the advancement reaction forces can be transferred from the drill head to the inner kelly over the controller.

14. Tunnel rock drill, for driving a tunnel bore optionally in open or shielded mode, comprising:

a drill head, a shield tail which is connected to the drill head and covers a part the bore wall over a defined length in the shielded mode and which does not cover the part of the bore wall in the open mode, a bracing device which can be optionally fixed in the tunnel bore and which serves to divert the reaction forces, generated by the tunnel bore during boring, at least one optionally activatable advancement device which, on the one hand, rests on the bracing device and, on the other hand, acts on the drill head in order to drive the drill head with advancing forces in the open mode, at least one optionally activatable force generator which has a variable length and which, on the one hand, rests on a tubbing support or an abutment for the tubbing support and, on the other hand, acts on the drill head in order to drive the drill head with advancement forces in the shielded mode, and an inner kelly whose breast-sided end bears the drill head and which can be moved in the direction of boring in relation to the bracing device by hinging the at least one advancement device to the inner kelly, wherein articulated connections between the drill head and the inner kelly are formed by ball joints.

15. Process for driving a tunnel bore, during which process the work varies from open to shielded mode, depending on whether the rock surrounding the tunnel bore is stable or soft, respectively comprising:

in open mode, exposing an area adjacent and behind a drill head and transferring advancement forces generated by at least one advancement device from a bracing device over an inner kelly, which bears the drill head on its breast-side end, and in shielded mode, shielding the area adjacent and behind the drill head, and introducing the advancement forces in the drill head over at least one force generator, acting between a tubbing support or an abutment for the tubbing support and the drill head.

16. Tunnel rock drill, for driving a tunnel bore optionally in open or shielded mode, comprising:

a drill head, a shield tail which is connected to the drill head and covers a part the bore wall over a defined length in the shielded mode and which does not cover the part of the bore wall in the open mode, a bracing device which can be optionally fixed in the tunnel bore and which serves to divert the reaction forces generated by the tunnel bore during boring, at least one optionally activatable advancement device which, on the one hand, rests on the bracing device and, on the other hand, acts on the drill head in order to drive the drill head with advancing forces in the open mode, at least one optionally activatable force generator which has a variable length and which, on the one hand, rests on a tubbing support or an abutment for the tubbing support and, on the other hand, acts on the drill head in order to drive the drill head with advancement forces in the shielded mode, and an inner kelly whose breast-sided end bears the drill head and which can be moved in the direction of boring in relation to the bracing device by hinging the at least one advancement device to the inner kelly, wherein articulated connections between the inner kelly and the bracing device are formed by ball joints.

* * * * *